US007321128B2

(12) United States Patent
Beziat et al.

(10) Patent No.: US 7,321,128 B2
(45) Date of Patent: Jan. 22, 2008

(54) CONTAINER FOR RADIOACTIVE MATERIALS AND PROCESS FOR CLOSING SAME

(75) Inventors: Alain Beziat, Tresques (FR); Richard Levoy, Reauville (FR)

(73) Assignee: Commissariat a l'Energie Atomique, Paris (FR)

( * ) Notice: Subject to any disclaimer, the term of this patent is extended or adjusted under 35 U.S.C. 154(b) by 352 days.

(21) Appl. No.: 10/529,616

(22) PCT Filed: Sep. 29, 2003

(86) PCT No.: PCT/FR03/02852

§ 371 (c)(1),
(2), (4) Date: Mar. 30, 2005

(87) PCT Pub. No.: WO2004/032152

PCT Pub. Date: Apr. 15, 2004

(65) Prior Publication Data

US 2006/0060801 A1 Mar. 23, 2006

(30) Foreign Application Priority Data

Oct. 1, 2002 (FR) ..... 02 12115

(51) Int. Cl.
*G21F 5/00* (2006.01)

(52) U.S. Cl. ..... 250/506.1; 250/505.1

(58) Field of Classification Search ..... 250/506.1, 250/505.1; 976/DIG. 166; 376/272
See application file for complete search history.

(56) References Cited

U.S. PATENT DOCUMENTS 3,116,767 A 1/1964 Blin et al.
4,486,512 A * 12/1984 Tozawa et al. ..... 428/623
4,508,969 A * 4/1985 Janberg et al. ..... 250/506.1
4,700,863 A * 10/1987 Filippi et al. ..... 220/613
5,391,887 A * 2/1995 Murray, Jr. ..... 250/506.1
5,787,688 A * 8/1998 Peulve et al. ..... 53/478

FOREIGN PATENT DOCUMENTS

DE 34 05 733 A1 8/1985
DE 34 05 735 A1 8/1985
DE 3405735 A * 8/1985
DE 3405735 A1 * 8/1985
FR 1.279.226 11/1961
JP 09262658 10/1997
JP 09262658 A * 10/1997

* cited by examiner

*Primary Examiner*—Terrell McKinnon
*Assistant Examiner*—Michael Maskell
(74) *Attorney, Agent, or Firm*—Pearne & Gordon LLP

(57) ABSTRACT

The invention relates to a container (1) for radioactive materials comprising a main hollow body (2) as well as a cover (6) made of at least one first metallic material, the cover being capable of being fixed on the main hollow body by means of sealing means (26) made of a second metallic material poured into a groove (24) defined by the cover and the main hollow body of the container. According to the invention, the cover (6) and the main hollow body (2) are made solid with the sealing means (26) by means of a bonding zone (28), formed by chemical reaction between the first and second metallic materials.

Figure 1:
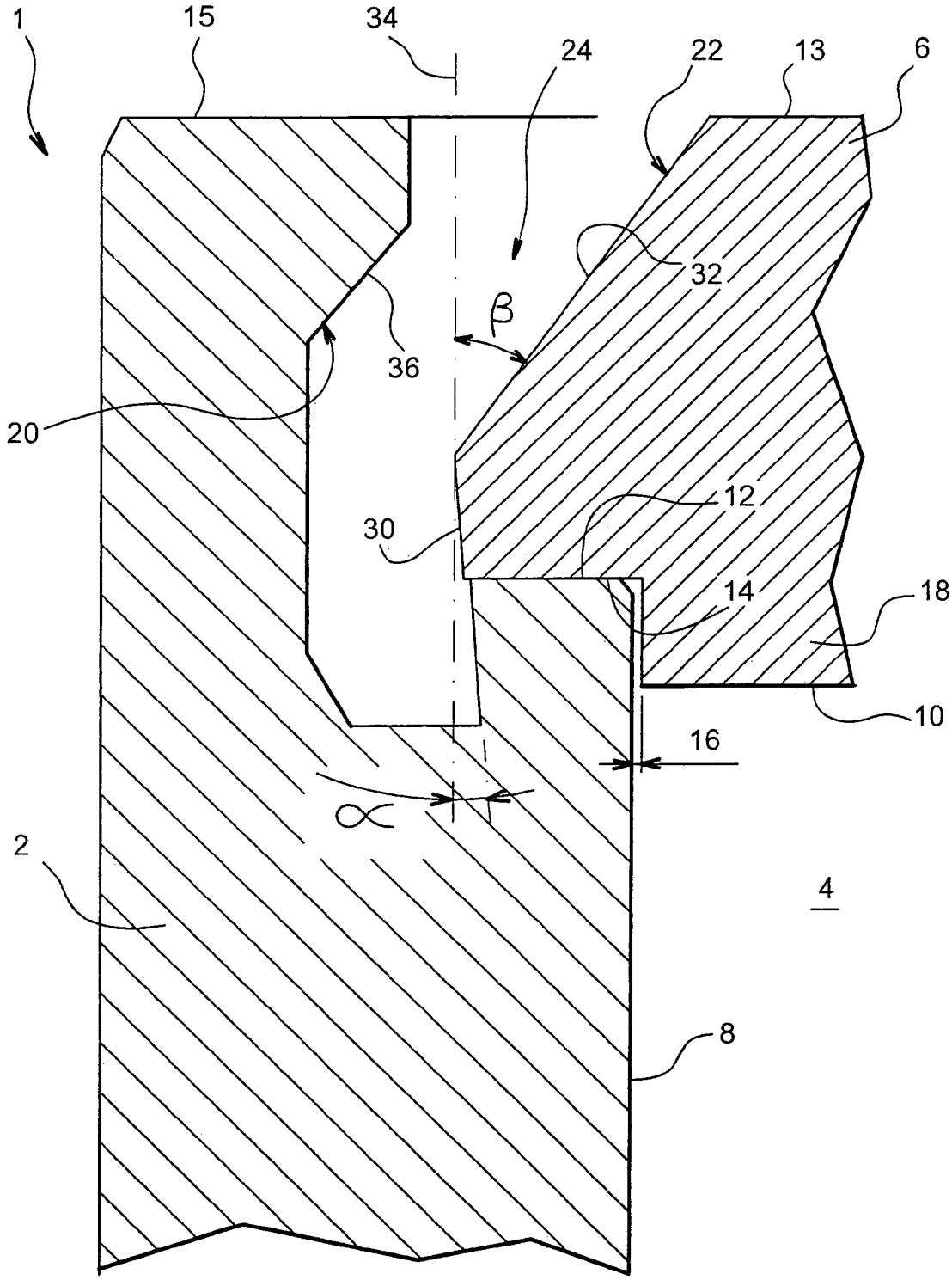

The invention likewise concerns a process for closing of such a container (1).

8 Claims, 3 Drawing Sheets

CONTAINER FOR RADIOACTIVE MATERIALS AND PROCESS FOR CLOSING SAME

TECHNICAL DOMAIN

The present invention relates to a container for radioactive materials such as waste or exothermic nuclear materials, the container being essentially constituted by a main hollow body inside which the radioactive materials are to be contained, as well as a cover for the main hollow body.

In addition, the invention likewise relates to a process for closing such a container.

The invention has particular application in the fields of nuclear waste treatment and conditioning.

PRIOR ART

In this particular technical domain, several examples have already been put forward.

Containers for radioactive materials whereof the main hollow body and the cover are assembled by welding are known in particular. If this technique employed remains satisfactory overall for containers made of standard steel or stainless steel, it is not however adapted to containers made of cast iron, this material however often being retained because of the possibility of its being obtained by recycling of very slightly contaminated metallic elements, originating from the dismantling of nuclear plants.

In fact, only weld seams of slight thicknesses, namely not exceeding 5 to 6 mm, can be envisaged on cast iron. In general, the constraints on conditioning radioactive materials impose a weld seam which extends over the full thickness of the container, which is usually between around 30 and 130 mm.

In addition, even in the case where welding is carried out on materials reputed to have good welding properties, the weld seams obtained on thicknesses such as those mentioned hereinabove are the seat of significant residual constraints, and these can be prejudicial to the durability of the container. In such a case, thermal detensioning treatments carried out at the same time as processes for conditioning waste nuclear are also carried out would be difficult to realise, and not totally efficacious on major thicknesses of the container wall.

In the prior art, it has likewise been proposed to interpose a metallic joint between the cover and the main hollow body assembled by screw-bolt joint, the joint being designed so a to present satisfactory technical characteristics for a limited duration, of the order of some decades. Nevertheless, apart from the existence of a constraint in limitation over time of such a metallic joint, this solution proves to be little effective when the container is stored in a corrosive environment. In fact, the thickness of material available at the face of the corrosion front is minor, and considerably reduces the period during which acceptable tightness is conserved between the cover and the main hollow body of the container.

To rectify the abovementioned disadvantages, the applicant has finally proposed a container made of cast iron comprising a cover fixed by sealing on the main hollow body, by projection of melted lead into a groove formed by the cover and the main hollow body of this container. When such a technique as described in the document FR-A-2 733 966 is made use of, the poured lead solidifies in the groove provided for this purpose, and forms a fixing element connecting the two main components of the container. It should be noted that connecting these elements originates essentially from the particular geometry of the groove, presenting at the level of the main hollow body a lateral surface in two portions inclined relative to the vertical according to acute and opposite angles, so as to create a corner effect preventing the cover from detaching from the main hollow body.

However, it has been noticed that with such an arrangement, the mechanical bond obtained between the cover and the main hollow body of the container was not fully satisfactory, thus causing doubts as to the presence of a perfect tight fit between these two elements, and as a consequence doubts concerning the presence of secure isolation of the radioactive materials inside the container.

In addition, the resulting lead joint is in no way adapted to support high temperatures, and cannot consequently enable storage of exothermal nuclear materials. In fact, since the melting temperature of the lead is only 327° C., this value then serves as a limit not to be exceeded for keeping mechanical contact between the two main elements constituting the container, this value even being able to be reduced in terms of the strong drop in mechanical characteristics of the lead beyond a certain temperature.

EXPLANATION OF THE INVENTION

The aim of the invention is thus to propose a container for radioactive materials comprising a main hollow body as well as a cover made of at least a first metallic material, the container at least partially rectifying the disadvantages mentioned hereinabove relative to the embodiments of the prior art.

More precisely, the aim of the invention is to present a container whereof the mechanical bond and tight fit between the cover and the main hollow body are considerably improved relative to the solutions already proposed.

In addition, the aim of the invention is to propose a process for the closing of such a container.

To achieve this, the object of the invention first of all is a container for radioactive materials comprising a main hollow body as well as a cover made of at least a first metallic material, the cover capable of being fixed on the main hollow body by means of sealing means made of a second metallic material poured into a groove defined by the cover and the main hollow body of the container. According to the present invention, the cover and the main hollow body are attached to the sealing means by means of a bonding zone, formed by chemical reaction between the first and second metallic materials.

Advantageously, the essential characteristic of the invention according to which the second metallic material poured into the groove is capable of reacting chemically with each first metallic material, allows the formation of a bonding zone constituted by intermetallic compounds ensuring a tight veritable metallurgic bond between the sealing means on the one hand, and the cover and the main hollow body of the container on the other hand.

The reliability of the close contact of the cover on the main hollow body of the container is thus largely augmented, especially relative to the solution described in the document FR-A-2 733 966. In fact, the sealing means provided in this prior art take the form of lead poured into a groove made of cast iron, the latter using a specific geometry ensuring the cover is kept in place on the main hollow body, when the lead is set in the groove. Now, contrary to the container according to the invention, no chemical reaction is produced between the lead and the cast iron due to the inexistence of iron-lead intermetallic compounds, this property therefore prohibiting the presence of this type of compound at the interface between the sealing means and the groove. As a consequence, since no rigid metallurgic bond is provided between the sealing means on the one hand and the cover and the main hollow body of the container on the other hand, the bond obtained between the cover and the main hollow body is not in a position to offer acceptable mechanical resistance, nor even durable tightness between these two main elements of the container.

Each first metallic material is preferably of the cast iron or steel type. In this manner, the second metallic material can be cast iron, zinc or one of its alloys, steel, or even aluminium or one of its alloys.

In such cases, the bonding zone can then be made up of alloys of the iron-carbon, iron-zinc or iron-aluminium type, these materials being capable of ensuring perfect mechanical resistance between the sealing means and the two main elements making up the container.

In addition, it is specified that the metallic materials indicated hereinabove, capable of being employed for making the sealing means, advantageously utilising a melting temperature higher than that of the lead utilised in the prior art, and are consequently capable of supporting the presence of exothermal radioactive materials inside the container. In addition, it is likewise specified that even if certain materials such as zinc and its alloys utilise a sufficiently high melting temperature to allow the storage of exothermal radioactive materials, the value of this temperature all the same advantageously allows relatively easy reopening of the cover, by means of classic means capable of causing fusion of the sealing means.

According to a preferred embodiment of the present invention, the bonding zone has an average thickness of between around 10 μm and 5 mm, such that the mechanical bond engendered between the cover and the main hollow body of the container is durably resistant and tight.

To increase this bond even more, it is possible to provide that the cover comprises an external lateral surface partially defining the groove and comprising two adjacent portions inclined respectively at an angle $\alpha$ and an angle $\beta$ relative to a direction parallel to a longitudinal principal axis of the container, the angles $\alpha$ and $\beta$ being acute and opposite in order to obtain a corner effect.

On the other hand, the object of the invention is likewise a process for closing a container for radioactive materials comprising a main hollow body as well as a cover made of at least a first metallic material, the process comprising a stage of placing the cover on the main hollow body of the container so as to form a groove between these two elements, followed by a stage of making sealing means ensuring fixation of the cover on the main hollow body of the container by pouring a second metallic material into the groove. According to the invention, the second metallic material is selected such that it is likely to react chemically with each first metallic material, so as to form a bonding zone between the sealing means on the one hand, and the cover and the main hollow body of the container on the other hand.

The stage of placing the cover is preferably followed by a stage pre-heating the first material constituting the groove, this latter stage likewise able to be preceded by preparation of the surfaces of the groove.

In addition, it is possible to provide that the stage of making the sealing means is preceded by a stage of excess pouring of the second metallic material into the groove over a predetermined period, so as to cause heating of the first metallic material constituting the groove, as well as washing the surfaces of this groove.

The stage of making the sealing means by pouring the second metallic material into the groove is preferably followed by a heating stage of this second material resting in the groove, so as to favour chemical reaction between the first and second metallic materials.

Other advantages and characteristics of the invention will emerge from the following detailed non-limiting description.

BRIEF DESCRIPTION OF THE DIAGRAMS

Figure 2:
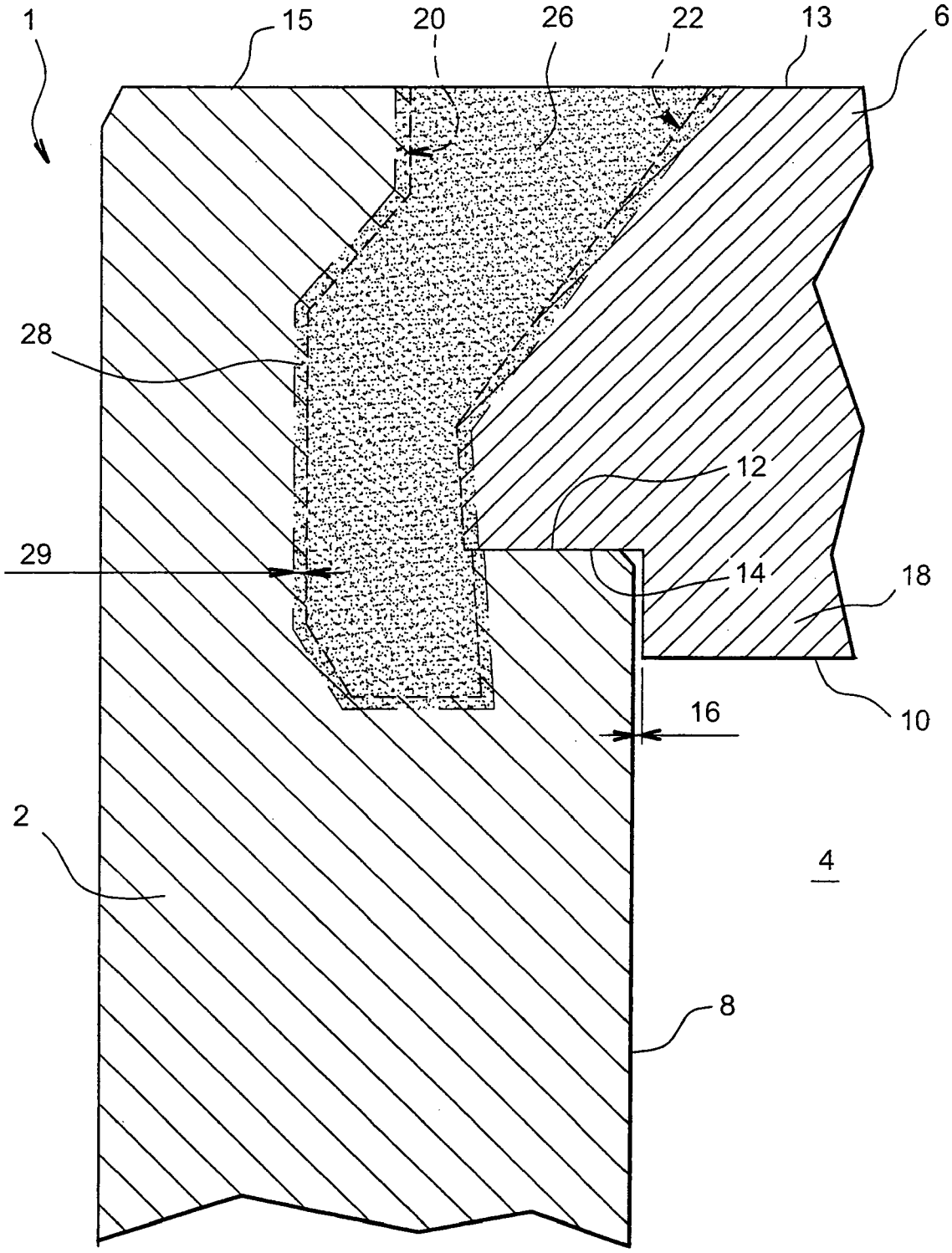
Figure 3:
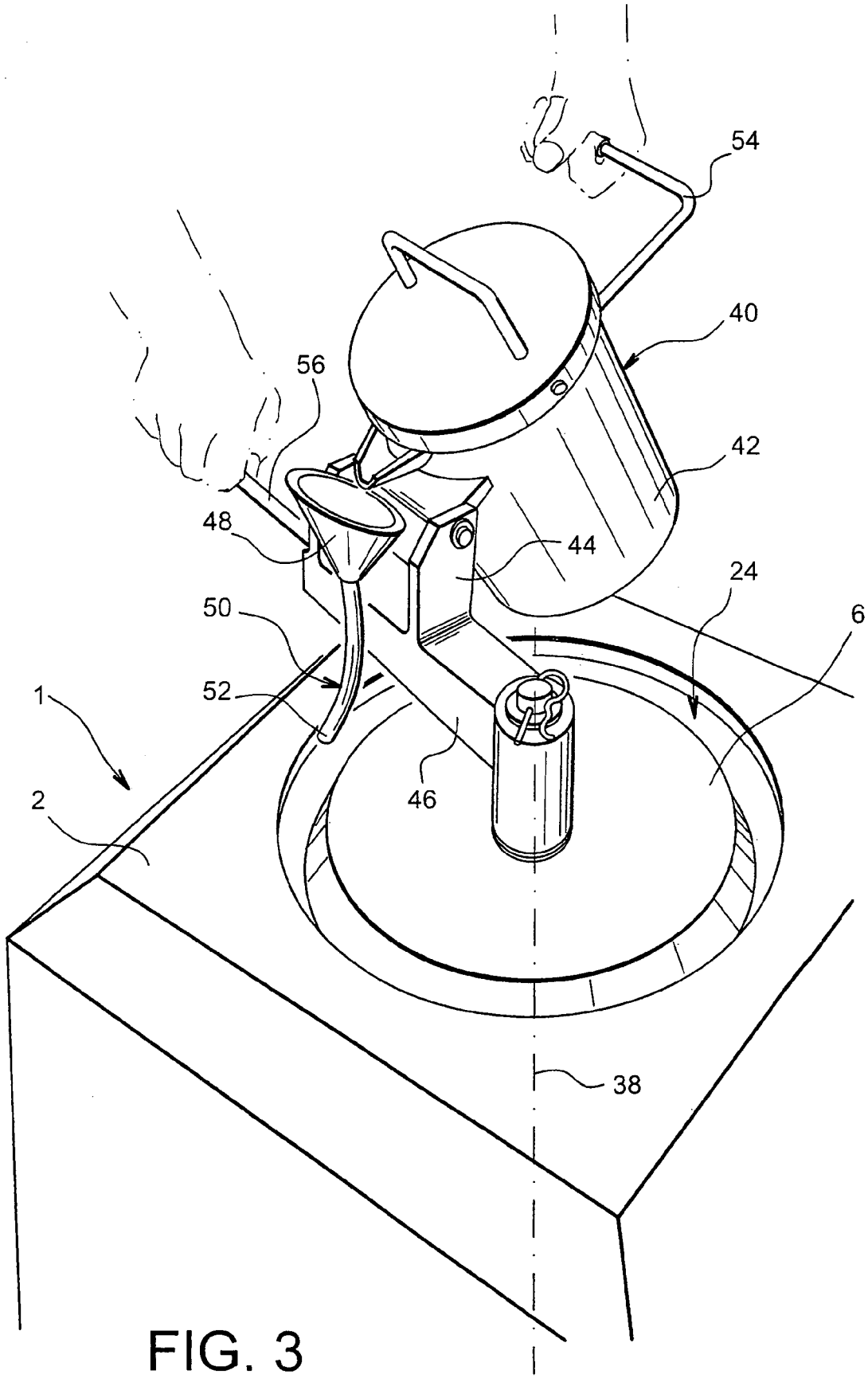

This description will be made with respect to the attached diagrams, in which;

FIG. 1 illustrates a partial schematic view in section of an upper portion of a container for radioactive materials, according to a preferred embodiment of the invention, and before the sealing means have been put in place, FIG. 2 illustrates partial schematic view in section of an upper portion of the container illustrated in FIG. 1, after setting of the sealing means in the groove, and FIG. 3 illustrates a schematic view in perspective of a particular arrangement, allowing the stage of making the sealing means of the process for closing a container according to the invention to be carried into effect.

DETAILED EXPLANATION OF PREFERRED EMBODIMENTS

With reference to FIGS. 1 and 2, they illustrate partially and schematically a container 1 for radioactive materials, according to a preferred embodiment of the present invention.

In these figures, only a part of the upper portion of the container 1 is visible, this container 1 being substantially cylindrical in shape and having a circular cross-section, but of course able to take on any other form compatible with the technical field in question.

The container 1 comprises a main hollow body 2, defining a space 4 inside which can be housed the radioactive materials, such as exothermal nuclear waste. In addition, the container 1 comprises a cover 6 capable of being encased by the main hollow body 2, so as to obtain a fully closed space 4.

The space 4, preferably circular in cross-section, is delimited on the one hand by means of a lateral surface 8 and a base (not shown) formed by the main hollow body 2, and on the other hand by means of an upper surface 10 formed by the cover 6, the latter as well as the main hollow body 2 being arranged in coaxial fashion.

As is visible in FIGS. 1 and 2, the main hollow body 2 and the cover 6 respectively utilise annular contact surfaces 12 and 14, allowing of the cover 6 relative to the main hollow body 2 to be stopped in translation, during encasing of these two elements 2 and 6. In addition, the contact surfaces 12 and 14 are preferably conceived such that the cover 6 can be lodged in the main hollow body 2 without projecting beyond the latter, and that their respective upper surfaces 13 and 15 are situated substantially in the same plane perpendicular to a longitudinal principal axis (not illustrated in these figures) of the container 1.

Of course, it is possible to provide clearance 16 between the lateral surface 8 of the space 4 and a cylinder 18 constituting the lower part of the cover 6, so as to facilitate introduction of this cover 6 into the main hollow body 2 of the container 1. By way of example, the clearance 16 can be of the order of 0.5 mm.

More specifically in reference to FIG. 1, on which the container 1 is illustrated while the cover 6 has not yet been fixed on the main hollow body 2, the latter presents in its upper portion an internal lateral surface 20, whereas the cover 6 presents an external lateral surface 22. When the cover 6 is put in place on the main hollow body 2, the lateral 20 and adjacent 22 and continuous surfaces form a groove 24 extending preferably all around the longitudinal principal axis of the container 1 according to a variable horizontal section, this groove 24 being open to the exterior of this container 1. It is specified that the groove 24 could naturally extend only partially around the longitudinal principal axis of the container 1, for example to form portions of angularly spaced grooves, without going beyond the scope of the invention. By the same token, note that the groove 24 can likewise be made so as to utilise a constant horizontal section, the form of this groove being easily modulated, by simple adaptation of the internal lateral surface 20 and of the external lateral surface 22.

The resulting groove 24 allows a space to open up in which sealing means 26 (shown in FIG. 2) will allow the cover 6 to be sealed onto the main hollow body 2 of the container 1.

In reference to FIG. 2, in which the container 1 is illustrated in a closed and fixed state, it is evident that the sealing means 26, previously poured into the groove 24 provided initially between the cover 6 and the main hollow body 2, have been introduced to this groove 24 so as to occupy the entirety of the space defined by this groove. In addition, when the sealing means 26 are in a set state such as that illustrated in FIG. 2, the surfaces 20 and 22 of the groove 24 are no longer apparent (but all the same sketched in dotted lines to facilitate comprehension), and the sealing means 26 are no longer in direct contact with the cover 6 and the main hollow body 2. In fact, the cover 6 and the main hollow body 2 on the one hand, and the sealing means 26 on the other hand, are separated by a bonding zone 28, having a form substantially identical to that of the wall of the groove 24 initially provided, over a thickness 29 ranging from 10 μm to 5 mm, and being preferably of the order of 2 mm.

The bonding zone 28, situated substantially at the initial placement of the external lateral surface 22 and of the internal lateral surface 20, results from a chemical reaction produced between the cover 6 and the main hollow body 2 on the one hand, and the sealing means 26 on the other hand, during pouring of the sealing means 26 into the groove 24. In this way, the bonding zone 28 ensures a rigid mechanical bond between the sealing means 26 and the two main elements 2 and 6 of the container 1, this specificity of the invention ensuring perfect tightness of the container.

To produce the bonding zone 28 by chemical reaction, the main hollow body 2 and the cover 6 are made of at least a first metallic material, and preferably of the same material such as steel or cast iron. In addition, the sealing means 26 are made of a second metallic material, such as cast iron, zinc or one of its alloys, steel, aluminium or one of its alloys, or again any other metallic material capable of having reactivity with the first metallic material, so as to react chemically with the latter and constitute a bonding zone 28 comprising intermetallic compounds.

Accordingly, by way of non-limiting example, when the cover 6 and the main hollow body 2 are made of steel and when the sealing means 26 are made of cast iron, these two materials are likely to react with one another when the cast iron is still liquid, so as to form a bonding zone 28 composed of a iron-carbon alloy, obtained by diffusion of the carbon of the cast iron to steel. Once the chemical reaction is completed and the sealing means 26 are set, the bonding zone 28 has a carbon gradient in a direction going from the sealing means 26 towards the cover 6 or the main hollow body 2 of the container 1, and the structure of this bonding zone 28 evolves from a mixture of de ferrite and perlite to cast iron, passing through a structure of eutectoid then hyper-eutectoid steel.

In the same way and still by way of example, when the sealing means 26 comprise zinc or aluminium, the bond zones 28 obtained are respectively composed of an iron-zinc alloy and an iron-aluminium alloy, ensuring rigid mechanical contact between the sealing means 26 and the two main elements 2 and 6 of the container 1. In addition, in the case of the use of zinc or one of its alloys, it has been noted that the bonding zone 28 had a structure similar to that observed in the case of galvanisation operations carried out by soaking steel elements in liquid zinc.

Finally, a last example relates to the case where the first and second materials are made of steel, the latter being selected such that carbon diffusion is possible when the sealing means 26 are in the liquid state, to produce a bonding zone 28 of iron-carbon alloy having a carbon gradient in a direction going from the sealing means 26 to the cover 6 or the main hollow body 2 of the container 1.

In order to even more reinforce fixing the cover 6 onto the main hollow body 2 of the container 1, it is possible to adapt the initial geometry of the groove 24, formed by the lateral internal surface 20 and the lateral external surface 22.

To this end, and in reference to FIG. 1, the external lateral surface 22 of the cover 6 may comprise two adjacent portions 30 and 32 inclined respectively at an angle $\alpha$ and at an angle $\beta$ relative to a direction 34 parallel to the longitudinal principal axis of the container 1, the angles $\alpha$ and $\beta$ being acute and opposite to produce a corner effect when it is intended to extract the cover 6 from the main hollow body 2. As can be seen in FIG. 1, the upper portion 32 is inclined so as to close in on the longitudinal principal axis by moving away towards the upper portion of the container 1, while the lower portion 30 is inclined so as to close in on the longitudinal principal axis by moving away towards a lower portion of the container 1.

In addition, it should be noted that the internal lateral surface 20 of the main hollow body 2 can likewise comprise a portion 36 inclined in the same manner as the upper portion 32 of the external lateral surface 22, namely so as to move towards the longitudinal principal axis by moving away towards the upper portion of the container 1, this portion 36 being preferably opposite the upper portion 32 of the external lateral surface 22. Therefore, when the sealing means 26 take their place in the groove 24, the part of these sealing means 26 located between the initially provided portions 32 and 36, substantially takes the form of a cap ensuring supplementary mechanical contact by the cover 6 on the main hollow body 2. Naturally, the form of the groove 24 can be conceived in any other manner aiming to provide a geometry ensuring contact by the cover 6 on the main hollow body 2, when the sealing means 26 are set inside this initially provided groove 24, without going beyond the scope of the invention.

And finally, it should be noted that the groove 24 has a variable width, capable of extending for example between 10 and 20 mm, and being of the order of 15 mm at the portions 32 and 36 opposite.

The invention likewise relates to a process for closing the container, such as that which has just been described hereinabove.

According to a first preferred embodiment of the process according to the invention which will be described hereinbelow, the first metallic material selected for making the cover 6 and the main hollow body 2 is steel, for example of type E24, whereas the second poured metallic material employed for forming the sealing means 26 is cast iron, for example of type EN-GJS-400-15.

The first stage of this process consists of placing the cover 6 onto the main hollow body 2 of the container 1, so as to form the groove 24, as is evident in FIG. 1.

While this process is being performed, it is then preferable to carry out a stage for preparation of the surfaces of the groove 24, namely the internal lateral surface 20 of the main hollow body 2 and the external lateral surface 22 of the cover 6.

To do this, several solutions are possible. In fact, the surfaces 20 and 22 can be prepared by means of a mechanical technique such as sanding, a chemical technique such as degreasing or pickling, an electrochemical technique or again by depositing a layer of metallic material such as zinc or nickel. By way of example, the surfaces 20 and 22 of the groove 24 can be nickel-plated to prevent oxidation of these surfaces as their temperature rises and in the presence of air. In addition, the techniques possible for depositing the layer of metallic material are taken from among classic techniques for metallic depositing, such as galvanisation for depositing zinc. Of course, the stage for preparation of the surfaces 20 and 22 of the groove 24 can consist on the combination of several of the techniques mentioned hereinabove.

Once preparation of the surfaces 20 and 22 of the groove 24 is completed, these surfaces 20 and 22 can then undergo a low-temperature pre-heating stage to prevent their oxidation, for example of the order of 400° C., by means of electric heating collars or any other means ensuring such a function. It should be noted that this operation can be carried out under neutral gas to totally avoid the harmful effects which oxidation of the surfaces 20 and 22 of the groove 24 might cause.

The next step is the process of pouring the cast iron into the groove 24, so as to form the sealing means 26 shown in FIG. 2.

In reference to FIG. 3, a possible arrangement for performing the pouring off the second metallic material in the groove 24 is illustrated, the latter being annular and having an axis identical to the longitudinal principal axis 38 of the container 1.

As is evident from this figure, means for pouring the cast iron 40, assembled on the cover 6 of the container 1, comprise a receptacle 42 in which is situated the cast iron in the liquid state. The receptacle 42 is mounted to pivot on a support 44 solid with the end of an arm 46, the latter being able to pivot about the longitudinal principal axis 38 of the container 1.

The liquid cast iron remaining in the receptacle is capable of being poured out into an orifice having the form of d'un funnel 48, likewise mounted on the arm 46 of the means 40. The funnel 48 communicates with an evacuation conduit 50, whereof the end 52 is oriented close to and opposite the groove 24. It should be noted that the funnel 48 is also able to pivot according to an axis parallel to the axis of rotation between the receptacle 42 and the support 44, this specificity being provided so as to ensure clean discharge of the liquid cast iron into the funnel 48, irrespective of the quantity of cast iron present in the receptacle 42. On the contrary, the rotations of the elements 42 and 48 relative to the support 44 can be made manually, respectively by means of by means of handles 54 and 56.

Thus, by having the arm 46 pivot about the axis 38, the end 52 of the cast iron evacuation conduit 50 can describe a circular movement allowing it to be constantly opposite the base of the groove 24, this specific characteristic thus ensuring the possibility of take advantage of uniform distribution of the cast iron inside this groove 24, during the pouring operation.

In this first preferred embodiment of the process according to the invention, the cast iron is then poured into the groove 24, for example at a temperature approaching 1470° C. As has been indicated, the pouring of the cast iron is carried out by putting the arm 46 of the means 40 in rotation about the longitudinal principal axis 38, indifferently manually or automatically.

Before the completed pouring is directly intended to form the sealing means 26, the cast iron can be poured in excess and continuously, to heat and wash the surfaces 20 and 22 of the groove 24, nickel-plated beforehand. A system for recovery of the supernatant cast iron (not shown) can then consist of means for evacuation of the cast iron situated at the bottom of the groove 24, or again means arranged on the surface for recovering the cast iron overflowing from this groove.

The pouring of cast iron in excess over a determined period thus eliminates the impurities present in the groove 24, and rapidly dissolves the layer of nickel deposited on the surfaces 20 and 22, in the aim of obtaining clean surfaces made of steel 20 and 22 allowing good chemical reaction with the cast iron. The period of pouring in excess can especially be determined as a function of the optimal temperature to be reached for the surfaces 20 and 22 of the groove 24, thus by taking into consideration diverse parameters such as the superficial area of these surfaces 20 and 22, the rate of cast iron, the temperature of the cast iron, etc. In addition, it is noted that this period can also depend on the thickness of the metallic deposit previously made on the surfaces 20 and 22 of the groove 24.

Typically, for a total surface of the groove 24 of around 400 $cm^2$, the filling time is around 40 seconds and the quantity of cast iron poured in excess for the washing and heating is of the order of 250 kg, or a rate of washing of 0.06 $kg/s.cm^2$.

When the sealing means are poured into the groove 24 and the heating and washing operations of this groove 24 are complete, an ultimate stage consists of heating the cast iron such that it remains liquid in the groove 24. The main aim of this stage is to favour diffusion of the carbon from the cast iron of the sealing means 26, to steel of the main hollow body 2 and of the cover 6 of the container 1. The diffusion of carbon then produces a bonding zone 28 of iron-carbon alloy, ensuring a tight mechanical bond, directly between the sealing means 26 on the one hand, and the main hollow body 2 and the cover 6 on the other hand.

This heating stage of the cast iron in the groove 24 can be performed by way of classic heating such as electric heating collars (not shown), at a temperature of the order of 500° C. for around 2 hours. It is specified that the duration of heating can be adapted so that the chemical reaction between the first and second metallic materials is completed, or so that the bonding zone 28 is sufficiently important to generate a perfect and tight mechanical bond between the cover 6 and the main hollow body 2 of the container 1.

As mentioned hereinabove in the description of the container 1, the bonding zone 28, obtained as a result of utilising such a process, has a microstructure evolving on a thickness 29 of around 2 mm, from a mixture of ferrite and perlite to cast iron, by passing through a structure of eutectoid then hyper-eutectoid steel.

Tests have shown that the bonding zone 28 had a resistance to breaking of around 276 MPa, for an elasticity limit of 146 MPa at 0.2%, and breaking elongation of the order of 33.1%.

In a second preferred embodiment of the process according to the invention, when the second metallic material is selected from among zinc and its alloys and when the first metallic material is from steel, the surfaces 20 and 22 of the groove 24 do not undergo preparation via metallic deposit such as nickel, but are dipped so as to obtain surfaces 20 and 22 capable of reacting easily with the poured zinc.

The other stages of the process are carried out substantially in the same way as those mentioned in the first preferred embodiment of the invention, with the difference that zinc is poured around 470° C., and that the post-poured heating is maintained at 500° C. for 4 hours.

After setting of the second metallic material, the bonding zone 28 is composed of an iron-zinc alloy, substantially identical to that obtained during galvanisation carried out by soaking steel pieces in liquid zinc.

Additionally and in general, irrespective of the first metallic material retained, the use of zinc or of one of its alloys as second metallic material is advantageous in the sense that the reopening of the cover 6 can be easily envisaged by fusion of the sealing means 26, in terms of the low melting temperature of this type of material.

According to a third preferred embodiment of the process according to the invention, when the second metallic material is selected from among aluminium and its alloys and when the first metallic material remains from steel, the stages are similar to those described previously in the two first preferred embodiments, with the difference that the pouring stage is preferably carried out under protection of a neutral gas. These specific operating conditions allow work to be carried out under an oxidising atmosphere, and consequently prohibit the formation of a layer of aluminium on the surfaces 20 and 22 of the groove 24, which would be strongly prejudicial to the chemical reaction between the iron and aluminium, and thus to the mechanical performances of the bonding zone 28.

Finally, it is specified that the reopening of the cover 6 sealed on the main hollow body 2 of the container 1 can easily be carried out by fusion of the sealing means 26. This fusion is carried out preferably by means of heating by torch, laser, induction or by resistors.

Of course, various modifications can be made by the specialist to the container 1 for radioactive materials and to the process for closing such a container which has just been described hereinabove, only by way of non-limiting examples.

The invention claimed is:

1. A container for radioactive materials comprising a main hollow body as well as a cover made of at least a first metallic material, said cover being fixed on the main hollow body by means of sealing means made of a second metallic material poured into a groove defined by the cover and the main hollow body of the container, wherein the cover and the main hollow body are made solid with said sealing means by means of a bonding zone, formed by chemical reaction between the first and second metallic materials, wherein the first metallic material comprises a material selected from the group consisting of cast iron and steel, and wherein the second metallic material poured is a material selected from the group consisting of aluminum and aluminum alloys, with the bonding zone being composed of an iron-aluminum alloy.

2. A container for radioactive materials comprising a main hollow body as well as a cover made of at least a first metallic material, said cover being fixed on the main hollow body by means of sealing means made of a second metallic material poured into a groove defined by the cover and the main hollow body of the container, wherein the cover and the main hollow body are made solid with said sealing means by means of a bonding zone, formed by chemical reaction between the first and second metallic materials, and wherein the bonding zone uses an average thickness of between 10 mm and 5 mm.

3. The container as claimed in claim 1 or claim 2, in which the cover comprises an external lateral surface partially defining said groove and comprising two adjacent portions inclined respectively at an angle $\alpha$ and an angle $\beta$ relative to a direction parallel to a longitudinal principal axis of the container, the angles a and $\beta$ being acute and opposite so a to produce a corner effect.

4. A process for closing a container for radioactive materials comprising a main hollow body as well as a cover made of at least a first metallic material, said process comprising a stage of placing the cover on said main hollow body of the container so as to form a groove between these two elements, followed by a stage of excess pouring the second metallic material in said groove over a determined period, so as to cause heating of the first metallic material constituting said groove as well as washing the surfaces of this groove, followed by a stage of making sealing means ensuring fixing of the cover onto the main hollow body of the container by pouring a second metallic material into said groove wherein the second metallic material is selected such that it reacts chemically with each first metallic material, so as to form a bonding zone between the sealing means on the one hand, and the cover and the main hollow body of the container on the other hand.

5. The process as claimed in claim 4, in which the stage of placing the cover is followed by a stage of pre-heating the first material constituting the groove.

6. The process as claimed in claim 5, in which the stage of pre-heating is preceded by a preparation stage of the surfaces of the groove.

7. The process as claimed in claim 6, in which the preparation stage of the surfaces of the groove is done by means of at least one preparation technique taken from the group constituted by mechanical, chemical and electrochemical techniques for preparation of surfaces, and techniques for depositing layers of metallic materials.

8. The process as claimed in claim 4, in which the stage of making the sealing means by pouring the second metallic material into said groove is followed by a heating stage of this second material resting in said groove, so as to favor chemical reaction between the first and second metallic materials.

* * * * *